US009392378B2

(12) United States Patent
Jensen

(10) Patent No.: US 9,392,378 B2
(45) Date of Patent: Jul. 12, 2016

(54) CONTROL OF OUTPUT MODULATION IN A HEARING INSTRUMENT

(75) Inventor: Niels Hellevad Jensen, Smørum (DK)

(73) Assignee: OTICON A/S, Smorum (DK)

( * ) Notice: Subject to any disclaimer, the term of this patent is extended or adjusted under 35 U.S.C. 154(b) by 592 days.

(21) Appl. No.: 13/585,491

(22) Filed: Aug. 14, 2012

(65) Prior Publication Data

US 2013/0044889 A1 Feb. 21, 2013

Related U.S. Application Data

(60) Provisional application No. 61/523,412, filed on Aug. 15, 2011.

(30) Foreign Application Priority Data

Aug. 15, 2011 (EP) ..... 11177559

(51) Int. Cl.
*H04R 25/00* (2006.01)

(52) U.S. Cl.
CPC ..... *H04R 25/356* (2013.01); *H04R 25/407* (2013.01); *H04R 2225/43* (2013.01)

(58) Field of Classification Search
CPC ..... H04R 25/356; H04R 2225/43
See application file for complete search history.

(56) References Cited

U.S. PATENT DOCUMENTS

| | | | | |
|---|---|---|---|---|
| 5,027,410 | A | 6/1991 | Williamson et al. | |
| 5,528,696 | A | 6/1996 | Ribic | |
| 6,198,830 | B1 | 3/2001 | Holube et al. | |
| 6,539,350 | B1 * | 3/2003 | Walker | 704/233 |
| 7,457,757 | B1 | 11/2008 | McNeill et al. | |
| 8,098,859 | B2 * | 1/2012 | Zeng et al. | 381/316 |
| 2002/0067838 | A1 | 6/2002 | Kindred et al. | |
| 2004/0175011 | A1 | 9/2004 | Schaub | |
| 2005/0197832 | A1 | 9/2005 | Vandali et al. | |
| 2006/0080087 | A1 | 4/2006 | Vandali et al. | |

FOREIGN PATENT DOCUMENTS

| | | | |
|---|---|---|---|
| EP | 0652686 | A1 | 5/1995 |
| EP | 0836363 | A1 | 4/1998 |
| EP | 1453355 | A1 | 9/2004 |
| WO | WO 2006/133431 | A2 | 12/2006 |

OTHER PUBLICATIONS

Plomp, R. "The negative effect of amplitude compression in multichannel hearing aids in light of the modulation-transfer function," J. Acoust. Soc. Am. vol. 83, No. 6, Jun. 1988, pp. 2322-2327.*

* cited by examiner

*Primary Examiner* — Duc Nguyen
*Assistant Examiner* — Kile Blair
(74) *Attorney, Agent, or Firm* — Birch, Stewart, Kolasch & Birch, LLP

(57) ABSTRACT

The present invention relates to a listening device for a hearing impaired person. The present invention furthermore relates to a corresponding operating method of operating a listening device and to a corresponding computer program. In particular, the present invention relates to a listening device that comprises a signal processing unit that is controlled by a controller configured to implement a combined feed-forward and feed-back control in order to ensure that both an electric input signal and a processed electric output signal have at least almost identical modulation index values. Thereby, speech intelligibility is increased, in particular for a hearing impaired person being capable of perceiving sound pressure levels in a substantially decreased dynamic range.

20 Claims, 5 Drawing Sheets

CONTROL OF OUTPUT MODULATION IN A HEARING INSTRUMENT

CROSS REFERENCE TO RELATED APPLICATIONS

This nonprovisional application which claims priority under 35 U.S.C. 119(e) to U.S. Provisional Application No. 61/523,412 filed on Aug. 15, 2011 and under 35 U.S.C. 119(a) to patent application Ser. No. 11/177,559.9 filed in Europe, on Aug. 15, 2011. The entire contents of all of the above applications are hereby incorporated by reference into the present.

FIELD OF THE INVENTION

The present application relates to a listening device, e.g. for a hearing impaired person. The present application furthermore relates to a corresponding operating method of operating a listening device and to a corresponding computer program. In all aspects of the present disclosure, a combined feed-forward and feed-back control is implemented in order to ensure optimal modulation in the acoustical output signal of the listening device.

BACKGROUND OF THE INVENTION

U.S. Pat. No. 7,457,757 B1 describes a method of increasing speech intelligibility of acoustic sounds recorded with a hearing aid, wherein an incoming signal is processed according to an adaptive algorithm. The incoming signal is fed to a signal processing stage that comprises a low pass filter, a high pass filter, an expander, a compressor and a pass band contour, wherein these components can be adaptively controlled, in particular turned on or off, through the adaption algorithm. It is described that a modulation depth of the incoming signal is determined by using an intelligibility measurement in order to obtain an estimation of a signal to noise ratio of the incoming signal. The adapted algorithm is used for computing and/or for choosing the best configuration parameters such that the incoming signal is optimally processed.

Even though the incoming signal is processed in dependence of a modulation depth of the input signal, speech intelligibility can be unsatisfactory, in particular for a hearing impaired person that can perceive sound pressure levels in a substantially decreased dynamic range only. WO 2006/133431 A2 describes a method of improving the naturalness of processed sound by separating the information-bearing spectral envelope from the voice-quality-bearing spectral fine structure. The spectral envelope (formants) are estimated in real time and shifted to a higher frequency range, whereas the fine structure is kept intact.

SUMMARY OF THE INVENTION

It is a technical object of the present invention to provide technical means for improving speech intelligibility of sound processed with a hearing aid, in particular regarding the preservation and enhancement of modulation. Modulation is particularly important to a hearing impaired person in order to obtain speech intelligibility. However, other parameters than modulation related to speech intelligibility may alternatively or additionally be considered (e.g. the frequency content of the input signal, the input level at different frequencies, etc., or combinations thereof). In accordance with a first aspect of the present invention, the technical object is achieved by a listening device for a hearing impaired person, which comprises the following components:

- an input transducer configured to provide an electric input signal representing an audio signal,
- a signal processing unit configured to process the electric input signal and to output a processed electric output signal,
- an input measurement unit configured to determine an input value of a modulation parameter (and/or another parameter related to speech intelligibility) of the electric input signal,
- an output measurement unit configured to determine an output value of the same modulation parameter (and/or another parameter related to speech intelligibility) of the processed electric output signal, and
- a controller coupled to the signal processing unit and being configured to control processing of the electric input signal through the signal processing unit in dependence of the determined input value and the determined output value.

The present disclosure includes the recognition that the prior art hearing aid is only capable of processing the incoming signal in dependence of the modulation depth of the incoming signal. Thus, the prior art hearing aid realizes a feed-forward control, only. However, the modulation of a signal representing speech is a crucial parameter for speech intelligibility. Thus, it should be ensured that the modulation (and/or another parameter related to speech intelligibility) of the incoming signal is processed in order to maximize speech intelligibility, in order to provide a pristine audio signal to a hearing aid wearer. The present disclosure furthermore includes the recognition that in order to ensure that the modulation of the processed output signal is optimally processed compared to the modulation of the incoming signal, it is advantageous to monitor the modulation of the processed output signal, too, and to control processing of the incoming signal in dependence of both modulations.

The listening device of the first aspect of the present invention realizes a combined feed-forward and feed-back control, wherein the two measurement units each determine values of the same modulation parameter of the electric input signal and the processed electric output signal. The controller controls the signal processing unit in dependence of the two determined values. In the outcome, the combined feed-forward and feed-back control of the signal processing unit allows for improvement of speech intelligibility, in particular for a hearing aid user having a pronounced hearing loss. A pronounced hearing loss can, e.g., be a moderate to severe hearing loss, e.g. a hearing loss in the range from 40 to 90 dB at one or more particular frequencies or in a particular frequency range of the human audible frequency range.

In an embodiment, the listening device is adapted to provide a frequency dependent gain to compensate for a hearing loss of a user. In an embodiment, the listening device comprises a signal processing unit for enhancing the input signals and providing a processed output signal. Various aspects of digital hearing aids are described in [Schaub; 2008] (Arthur Schaub, Digital hearing Aids, Thieme Medical. Pub., 2008).

In an embodiment, the listening device comprises an output transducer (e.g. a loudspeaker) coupled downstream of the signal processing unit and configured to convert the processed electric output signal into an acoustic output signal to be presented to the hearing impaired person. In an embodiment, the output transducer comprises a number of electrodes of a cochlear implant or a vibrator of a bone conducting hearing device.

In an embodiment, the listening device comprises an input transducer for converting an input sound to an electric input signal. In an embodiment, the input transducer comprises a microphone, e.g. two or more microphones. In an embodiment, the listening device comprises a directional microphone system. In an embodiment, the directional microphone system is adapted to separate two or more acoustic sources in the local environment of the user wearing the listening device. In an embodiment, the directional system is adapted to detect (such as adaptively detect) from which direction a particular part of the microphone signal originates.

In an embodiment, the listening device (e.g. the input transducer) comprises an antenna and transceiver circuitry for wirelessly receiving a direct electric input signal from another device, e.g. a communication device or another listening device. In an embodiment, the listening device (e.g. the input transducer) comprises a (possibly standardized) electric interface (e.g. in the form of a connector) for receiving a wired direct electric input signal from another device, e.g. a communication device or another listening device. In an embodiment, the listening device is adapted to provide that the electric input signal provided by the input transducer comprises or is equal to said direct electric input signal. In an embodiment, the listening device comprises a selector or mixer allowing to select the electric input signal from one of a microphone input and a direct electric input (or to provide a mixture of the two). In an embodiment, the listening device comprises demodulation circuitry for demodulating the received direct electric input to provide the direct electric input signal representing an audio signal and/or a control signal e.g. for setting an operational parameter (e.g. volume) and/or a processing parameter of the listening device.

In an embodiment, the listening device comprises a forward or signal path between the input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs, e.g. in a particular acoustic environment. In an embodiment, the listening device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the listening device, e.g. the input transducer (e.g. a microphone or the transceiver unit) comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain.

In an embodiment, the frequency range considered by the listening device from a minimum frequency $f_{min}$ to a maximum frequency $f_{max}$ comprises a part of the typical human audible frequency range from 20 Hz to 20 kHz, e.g. a part of the range from 20 Hz to 10 kHz. In an embodiment, the frequency range [$f_{min}$; $f_{max}$] considered by the listening device is split into a number P of frequency bands, where P is e.g. larger than 5, such as larger than 10, such as larger than 50, such as larger than 100, at least some of which are processed and/or analyzed individually.

In an embodiment, the controller is adapted to limit the control of the processing of the electric input signal with a view to the modulation values of the electric input and output signals in a limited frequency range [$f_{low}$; $f_{high}$], e.g. in a frequency range where speech intelligibility is primarily influenced. In an embodiment, the frequency range [$f_{low}$, $f_{high}$] comprises the range from 250 Hz to 6 kHz, e.g. the range from 300 Hz to 4 kHz.

In a particular embodiment, the listening device comprises a voice detector for determining whether or not an input signal comprises a voice signal (at a given point in time). A voice signal is in the present context taken to include a speech signal from a human being. It may also include other forms of utterances generated by the human speech system (e.g. singing). In a preferred embodiment or mode of operation, the voice detector is specifically adapted to determine whether or not speech is present in the input signal. In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. noise). Thereby an average noise level and an average target signal level can be determined. In an embodiment, the voice detector is adapted to detect as a VOICE also the user's own voice. Alternatively, the voice detector is adapted to exclude a user's own voice from the detection of a VOICE. A speech detector is e.g. described in WO 91/03042 A1.

In an embodiment, the adaptation of the output modulation (and/or other parameters related to speech intelligibility) as proposed in the present application is only activated in a specific mode of operation (e.g. in a particular program of the listening device). In an embodiment, the adaptation of the output modulation as proposed in the present application is only activated during time periods, where speech is identified in the electric input signal. This can e.g. be based on a control signal from a voice or speech detector that monitors the electric input signal.

The modulation parameter can e.g. be a modulation index (also referred to as modulation depth) i.e. an amplitude modulation index. The modulation index describes by how much a variable modulated in the electric input signal, or, respectively in the processed electric output signal, varies around its unmodulated level. The terms modulation or modulation index are to be understood as following the standard definition in acoustic signal processing, if nothing else is specifically indicated.

In an embodiment, the input measurement unit and the output measurement unit are each configured to calculate a respective envelope signal of the electric input signal or, respectively, of the processed electric output signal. In this embodiment, the modulation parameter is a difference between a maximum value and a minimum value in a respective calculated envelope signal. For calculating the respective envelope signal, the input measurement unit and/or the output measurement unit can apply the Hilbert Transformation algorithm. Alternatively, a simplified calculation of the modulation depth may be used, e.g. by rectification and low-pass filtering.

In an embodiment, the listening device is adapted to maintain the modulation present in the input signal in the output signal. This may be advantageous under certain circumstances, but not necessarily always. For example the dips in the modulation can have a level lower than the hearing impaired persons' hearing threshold. In this case (among others), it is not advantageous to simply maintain the input modulation depth on the output. The resulting modulation in the output signal is in such case preferably determined with a view to the user's hearing loss. In other cases it may be an advantage to increase the modulation.

In all cases the object is to enhance speech intelligibility.

It will more generally speaking however be an advantage to relate the signal processing to the hearing loss of a user (and preferably to a user's comfort level, cf. e.g. FIG. 5*a*), the input modulation and the output modulation. This can be done in numerous ways.

The present invention may advantageously (in addition to hearing aids for compensating for a user's hearing impairment) be used in headsets and other products for the normal hearing. In an embodiment, the listening device comprises a headset, an active ear protection device, a headphone or a combination thereof. The cues in the sound, for example cues related to the modulation in speech, may be changed by signal processing algorithms. The core of the idea is not only to relate the signal processing strategy to the modulation of the sound environment, but also to analyze the overall effect of the signal processing strategy, specifically the resulting modulation depth after all processing algorithms (e.g. noise reduction, directionality, anti-feedback, compression, etc.) have processed the sound and potentially changed the modulation depth.

Other inputs to the controller may be used as well. The essence is to monitor the influence of the signal processing algorithms on the output modulation and use the result to influence or control the signal processing (i.e. a feedback mechanism).

In an embodiment, the listening device comprises a hearing aid adapted to compensate for a hearing loss of a hearing impaired user. Due to the typically reduced dynamic range of acceptable input signal levels of a hearing impaired user, i.e. such levels where the input sound is audible as well as comfortable (this function being taken care of by the amplification and compression mechanisms of the listening device), a given input modulation, e.g. representing a speech signal, will be reduced at the output by the listening device (to comply with the reduced dynamic range of the user). If the input and the output modulation were equal (or if the output modulation were larger than the input modulation) in such case, it would most likely be perceived as an exaggerated (and possibly uncomfortable) modulation by a hearing impaired user because of recruitment.

In an embodiment, the controller is configured to control the signal processing unit such that a difference between the input value of the modulation parameter and the output value of the modulation parameter is changed over time in order to obtain a predefined (audiological) target modulation. Other targets than modulation may alternatively or additionally be addressed.

In an embodiment, the controller is configured to control amplifying of the electric input signal through the signal processing unit in dependence of a predefined compression scheme according to which an output amplitude level of the processed electric output signal is decreased relative to an input amplitude level of the electric input signal, if the amplitude level of the electric input signal is larger than a first threshold value (as is typically the case for a hearing impaired user, or for a normal hearing user at large input levels as a means of ear protection). The level of compression may preferably be individualized according to a particular user's needs. In an embodiment, a reference output modulation (and a corresponding reference output value) is defined by the output modulation that would result (for a given input signal and amplification), if the only gain reducing activity were the predefined compression scheme. In practice, output gain (and output modulation) may be reduced at the 'request' of one or more further algorithms or functions of the listening device, such as maximum output power restrictions (either defined by the user's discomfort level or by the performance of the listening device), output AGC (automatic gain control), noise reduction, feedback cancellation, etc. In an embodiment, a requested output modulation (and a corresponding requested output value) is defined as the output modulation resulting from said compression scheme and all other algorithms and functions that are in action at a given point in time (to modify the input signal and provide a resulting output signal) without the action of the controller according to the present disclosure. In an embodiment, an enhanced output modulation (and a corresponding enhanced output value) is defined as the output modulation provided by the controller according to the present disclosure. In an embodiment, the controller is configured to control the signal processing unit to provide an enhanced output modulation that is larger than the requested output modulation (at least in a specific mode of operation, e.g. depending on a classification of the input signal and/or of the processed input signal, e.g. based on the input and/or output modulation).

In an embodiment, the controller is configured to control the signal processing unit such that a difference between the input value of the modulation parameter and the output value of the modulation parameter is reduced over time, preferentially reduced towards a predefined (e.g. user specific) threshold value (e.g. so that the output value converges towards the reference output value), or minimized. According to the aforesaid, speech intelligibility is particularly improved for a designated wearer of the listening device, if the deviation of the output value of the modulation parameter compared to the input value of the modulation parameter is minimized (e.g. in the sense that the (enhanced) output value is in a range between the requested output value and the reference value or (e.g., in a particular 'Speech Intelligibility'-mode, even larger than the reference value)). Thus, the combined feed-forward and feed-back control substantially maintains the modulation of the electric input signal in the processed electric output signal (e.g. in the meaning that the (enhanced) output value for a given input signal (after the application of relevant algorithms and other functional elements to the input signal) is maintained or even increased compared to the reference output value).

It shall be understood that maintaining the modulation of the electric input signal in the processed electric output signal does not necessarily mean that the processed electric output signal is equal in amplitude compared to the electric input signal. Rather, in a preferred embodiment, the signal processing unit is configured to process the electric input signal by amplifying the electric input signal in dependence of a frequency of the electric input signal (e.g. individually in a number of frequency bands). Thus, the signal processing unit amplifies/compresses the electric input signal in such a way that, e.g., a value of the frequency modulation index is substantially the same for the electric input signal and the processed electric output signal (or so that a predefined (audiological) target modulation index is provided in the processed electric output signal).

In an example, the controller controls the signal processing unit by setting processing parameters in the signal processing unit. For instance, the controller determines a control signal in dependence of the determined input value and the determined output value and forwards the control signal to the signal processing unit. In an embodiment, one or more algorithms run by the signal processing unit to enhance the signal of the forward path are modified based on the control signal. The signal processing unit is, in an embodiment, configured to adapt itself in dependence of the forwarded control signal and to process the electric input signal so as to control the modulation of the processed electric output signal. In particular, processing can include amplification of the electric input signal, preferentially such that the modulation of the electric output signal is optimized with respect to speech intelligibility.

In another preferred embodiment, the controller is configured to control amplifying of the electric input signal through the signal processing unit in dependence of a predefined compression scheme according to which:

an output amplitude level of the processed electric output signal is decreased relative to an input amplitude level of the electric input signal, if the amplitude level of the electric input signal is larger than a first threshold value and the amplitude level of the processed electric output signal is kept constant at a maximum power output level, if the amplitude level of the electric input signal is larger than a second threshold value being larger than the first threshold value.

The compression scheme (cf. FIG. 4) is preferentially adapted to the individual impairment of the hearing impaired person designated to use the listening device. For instance, the compression scheme has been calculated within a fitting procedure (whereby predefined reference output values, as defined above, can be determined). In an embodiment, the signal processing unit is controlled such that the modulation in the processed electric output signal is substantially identical to (or even larger than) the modulation of the electric input signal. In an embodiment, the signal processing unit is controlled such that the modulation in the processed electric output signal is substantially identical to (or even larger than) the reference modulation.

In yet a further preferred embodiment, the controller is configured to dynamically adapt the maximum power output level in dependence of the input and the output value of the modulation parameter and the input amplitude level.

In another preferred embodiment, the listening device additionally comprises a filter apparatus that is configured to separate the electric input signal into a number of frequency bands. In this embodiment, the signal processing unit, the input measurement unit, the output measurement unit and the controller are configured to operate in each of the number of frequency bands. Thus, the electric input signal is analyzed in the number of frequency bands and a plurality of respective input values of the modulation parameter are determined by the input measurement unit, e. g. one for each frequency band. Furthermore, the signal processing unit processes each of the frequency bands separately. Also, the output measurement unit determines an output value of the modulation parameter for each of the processed frequency bands. The controller controls the signal processing unit such that the modulation parameters in each of the frequency bands of the processed electric output signal are substantially optimized (e.g. to be identical to the determined values of the corresponding frequency bands of the electric input signal or to predefined target values).

In an embodiment, the controller is configured to adapt the compression ratio (i.e. the slope of an output level vs. input level curve) with a view to a user's hearing ability, e.g. the frequency dependent hearing threshold and comfort level curves of the user (cf. FIG. 4, 5). In an embodiment, the controller is configured to adapt the compression ratio individually at different frequencies. In an embodiment, the controller is configured to adapt the average output level at a given frequency with a view to a user's hearing ability, e.g. the frequency dependent hearing threshold and comfort level curves of the user (cf. FIG. 4, 5). In an embodiment, the controller is configured to adapt the average output level at a given frequency to a median (or average) level between the user's hearing threshold and comfort levels (see e.g. thin dotted line MED in FIG. 5*a*). This has the advantage of providing optimal room for the output modulation.

In an embodiment, the controller is configured to decrease the compression ratio (compared to a predefined scheme, e.g. determined in a fitting procedure) at a given frequency based on the current input and output values of modulation (and possibly on other parameters, e.g. input level) to enhance speech intelligibility (and whereby a possible sequential compression-expansion procedure may be avoided).

In another preferred embodiment of the listening device, the input transducer is configured to detect an acoustic target source and to provide the electric input signal as a directional electric input signal in dependence of the detected acoustic target source. In an embodiment, the listening device is adapted to separate the input signal in a target signal (e.g. representing a voice) and a noise signal (e.g. representing all other sound signals except the target signal). In an embodiment, the listening device is adapted to determine a (time dependent) signal to noise ratio. In an embodiment, the listening device is adapted to a voice of a speaker speaking to the hearing impaired person wearing the listening device. Thereby, speech intelligibility is furthermore increased for a designated wearer of the listening device. The idea here is that in the process of analyzing the input and the output modulation in order to obtain optimal signal processing resulting in an output modulation which provides optimal speech intelligibility, it may be useful to distinguish between target and noise on the input of the controller when analyzing the sound environment. Similarly other analysis methods of the input as well as the output signal may be advantageous.

In an embodiment, the signal processing unit is adapted to run an algorithm for providing a measure of the intelligibility of a target speech signal when subject to noise and/or of a processed or modified target signal. In an embodiment, the controller is adapted to control the processing of the electric input signal through the signal processing unit in dependence of the determined input value, the determined output value and the measure of the intelligibility. Algorithms for providing a measure of the intelligibility of a signal comprising target speech are e.g. described in [Taal et al.; 2010].

The input transducer can comprise a microphone and an analogue-to-digital converter. Analogously, the output transducer can comprise a digital-to-analogue converter for converting the processed electric output signal into an analogue output signal and a loud speaker for converting the analogue signal into an acoustic output signal to be rendered to the hearing impaired person.

The listening device can be any kind of a hearing aid, a hearing instrument, an in-the-ear (ITE) hearing aid, a completely-in-cannel (CIC) hearing aid, a behind-the-ear (BTE) hearing aid, a receiver-in-the-ear (RITE) hearing aid, or any combination thereof. The listening device can also be a headset or an ear protection device or other devices constructed for normal hearing people, but e.g. adapted for being used under difficult listening circumstances, where speech enhancement techniques are desirable.

In accordance with a second aspect of the present invention, the above identified technical object is achieved by a method of operating a listening device for a person, e.g. a hearing impaired person, the method comprising the following steps:

- receiving an audio signal and converting the audio signal into an electric input signal,
- processing the electric input signal and outputting a processed electric output signal,
- determining an input value of a modulation parameter (and/or another parameter related to speech intelligibility) of the electric input signal and an output value of the same modulation parameter (and/or another parameter related to speech intelligibility) of the processed electric output signal, and
- controlling processing of the electric input signal in dependence of the determined input value and the determined output value.

The operating method of the second aspect of the present invention principally shares the advantages of the listening device of the first aspect of the present invention. In particular, the operating method has preferred embodiments in correspondence with the additional optional features of the listening device of the first aspect of the invention described above. For instance, in a preferred embodiment, the method includes the additional step of controlling processing of the electric input signal, such that a difference between the input value and the output value is changed over time according to data collected and analyzed by the listening device and optionally by user interaction directly or for example in a program operated by the user or by an audiologist. In an embodiment, a difference between the input value and the output value is changed over time in order to obtain a predefined (audiological) target modulation. Other targets than modulation may alternatively or additionally be addressed. In case the method relates to a hearing impaired person, it is furthermore preferred that the step of processing includes the step of amplifying the electric input signal, preferentially according to a compression scheme that is adapted to the hearing impairment of a designated wearer of the listening device.

According to a third aspect of the present invention, the above identified object is achieved by a computer program for operating a listening device, the computer program comprising program code means for causing the listening device to carry out the steps of a method of the second aspect of the present invention, when the computer program is run on a computer controlling the listening device.

The computer program of the third aspect of the invention may be stored/distributed on a suitable medium, such as an optical storage medium or a solid-state medium supplied together with or as part of other hardware, but may also be distributed in other forms, such as via the Internet or other wired or wireless telecommunication systems.

It shall be understood that listening device of the first aspect of the invention, operating method of the second aspect of the invention and the computer program of the third aspect of the invention have similar and/or identical preferred embodiments, in particular, as defined in the dependent claims.

It shall be understood that a preferred embodiment of the invention can also be any combination of the dependent claims with the respective independent claim.

These and other aspects of the invention will be apparent from and elucidated with reference to the embodiments described hereinafter.

DESCRIPTION OF EMBODIMENTS

Figure 1:
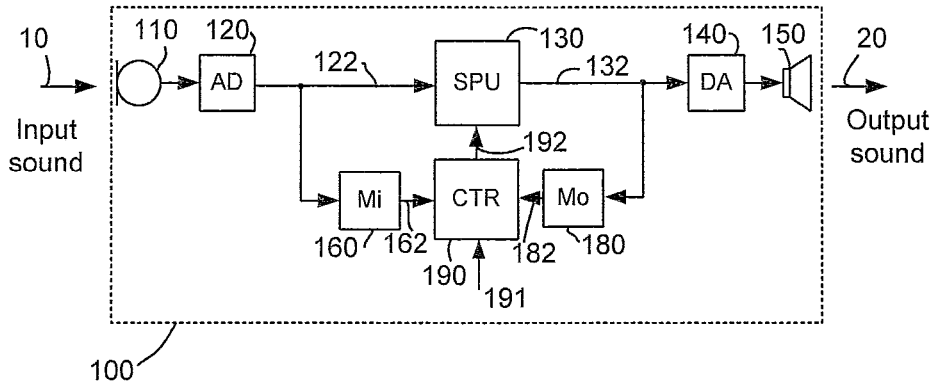
FIG. 1 shows a schematic and exemplary block diagram representation of a listening device in accordance with the first aspect of the present application.

FIG. 1 shows exemplary and schematically a block diagram representation of a listening device 100 in accordance with the first aspect of the present invention. The listening device 100 serves for improving speech intelligibility of recorded sound to be rendered to a hearing impaired person that can perceive acoustic sound in a decreased dynamic range of sound pressure levels only or to a person located in an acoustic environment, where speech intelligibility is reduced (e.g. a noisy environment).

The listening device 100 receives an audio signal (Input sound) 10 with an input transducer that comprises a microphone 110 and an analogue-to-digital converter (AD) 120 for converting the audio signal 10 into an electric input signal 122. The electric input signal 122 is processed (in a main or forward signal path) by a signal processing unit (SPU) 130 into a processed electric output signal 132. An output transducer comprising a digital-to-analogue converter (DA) 140 and a loud speaker 150 converts the processed electric output signal 132 into an acoustic output signal (Output sound) 20 to be rendered to the hearing impaired person. The components in this main signal path are arranged in a conventional manner, wherein the signal processing unit is connected downstream of the input transducer 110, 120 and upstream of the output transducer 140, 150. The input transducer may alternatively (or additionally) comprise a receiver (e.g. wired or wireless) for directly receiving and extracting an audio signal, thereby providing the electric input signal 122. Preferably, the input transducer (e.g. comprising a microphone and/or a transceiver unit) comprise(s) a TF-conversion unit (e.g. an analysis filter bank) for providing a time-frequency representation of an input signal. Preferably, the electric input signal is analyzed and processed in a number of frequency bands. Preferably, the output transducer comprises a time-frequency to time conversion unit (e.g. a synthesis filter bank) to provide an output signal in the time domain for presentation to a user and to be perceived by the user as a sound signal.

A controller (CTR) 190 is coupled to the signal processing unit 130 and controls the same by providing a control signal 192. The controller 190 implements a combined feed-forward and feed-back control, wherein an input measurement unit (Mi) 160 determines an input value of a modulation parameter of the electric input signal 122 and an output measurement unit (Mo) 180 determines an output value of the same modulation parameter of the processed electric output signal 132 and the controller determines the control signal 192 in dependence of the determined input value and output value 162 and 182. The controller 190 controls the signal processing unit 130 such that a difference between the input value of the modulation parameter 162 and the output value of the modulation parameter 182 (or the output value of the modulation parameter itself) is optimized, e.g. to obtain a predefined audiological target modulation. Thereby, the acoustic output signal 20 can be provided to the hearing impaired person with a view to the audio signal 10, as the modulation of the electric input signal 122 is optimized (e.g. substantially maintained) in the processed electric output signal 132. Preferably a user's hearing ability is considered in the controller (e.g. represented by input 191, e.g. from a memory or other unit), e.g. in the form of a user's hearing threshold level and/or a user's comfort level, cf. e.g. FIG. 5. Thereby the output modulation can be optimized with a view to the users hearing ability (and e.g. adapted not to exceed the limits provided by the user's hearing threshold and comfort levels). Other parameters may further be used to influence the processing with a view to optimized speech intelligibility. In an embodiment, a speech intelligibility measure is used to evaluate the quality of the output signal with respect to speech intelligibility. In an embodiment, the signal processing performed by the signal processing unit 130 (including the control of output modulation) is controlled by the controller 190 by control signal 192 to optimize said speech intelligibility measure. The speech intelligibility measure may e.g. be the speech-intelligibility index (SII), standardized as ANSI S3.5-1997 or as described in [Taal et al., 2010] (C. H. Taal, R. C. Hendriks, R. Heusdens, and J. Jensen, "A Short-Time Objective Intelligibility Measure for Time-Frequency Weighted Noisy Speech," IEEE International Conference on Acoustics, Speech, and Signal Processing (ICASSP), 14-19 Mar. 2010, pp. 4214-4217) or [Elberling et al., 1989] (C. Elberling, C. Ludvigsen, P. E. Lyregaard, "DANTALE: a new Danish speech material", Scandinavian Audiology, Vol. 18(3), pp. 169-75, 1989.

Figure 3:
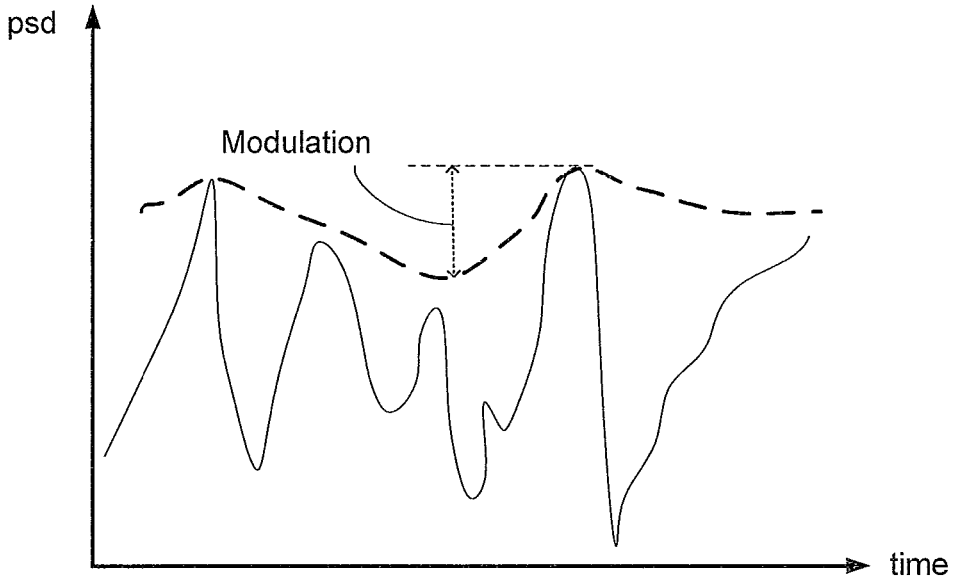
FIG. 3 shows an exemplary course of a power spectrum density of an electric input signal over time.

In an example, the modulation parameter is the difference between a maximum value of an envelope signal and a minimum value of the envelope signal. In this example, the input measurement unit 160 calculates an input envelope signal associated with the electric input signal 122, e.g., by applying a Hilbert Transformation algorithm (or other envelope extraction means). Analogously, the output measurement unit 180 calculates an output envelope signal associated with the processed electric output signal 132, e.g., by applying a Hilbert Transformation algorithm. An example of such envelope signal is depicted in FIG. 3, wherein the continuous line illustrates the course of a power spectrum density (psd) of an electric signal (electric input signal 122 or processed electric output signal 132) and the dashed line indicates an envelope signal associated with the power spectrum density course. The modulation parameter (Modulation) value is e.g. taken as the difference between a positive and a negative peak value of the (top) envelope of the signal (the dashed curve), taken over an appropriate time, e.g. related to the variation of the input signal, or the sampling rate of the AD-converter (e.g. of the order of 10 ms or 100 ms). In this example, the signal processing unit 130 is controlled by the controller 190, such that the difference between the peak values is the same for the envelope signal associated with the electric input signal 122 and the envelope signal associated with the electric output signal 132 (or is adapted to obtain a predefined (audiological) output target modulation). Alternatively or additionally, the signal processing unit 130 is controlled by the controller 190, such that the output modulation is located within the 'window' defined by a user's hearing threshold and comfort levels (cf. e.g. FIG. 5). In another example, the modulation parameter is another expression of the amplitude modulation. In an embodiment, the modulation parameter is a modulation index as defined by a difference between a top and a bottom envelope (top and bottom tracker) of the power density curve of the input signal, cf. e.g. WO 2005/086536 A1. In particular, processing of the electric input signal 122 through the signal processing unit 130 can include amplifying the electric input signal 122. For example, the controller 190 stores (in a memory) a predefined compression scheme that is adapted to the hearing impairment of the designated user of the listening device 100 (cf. e.g. FIG. 4). Such compression scheme can be defined within a fitting procedure. The controller 190 controls the signal processing unit in accordance with the stored compression scheme (and the input and output values of a modulation parameter).

Figure 4A:
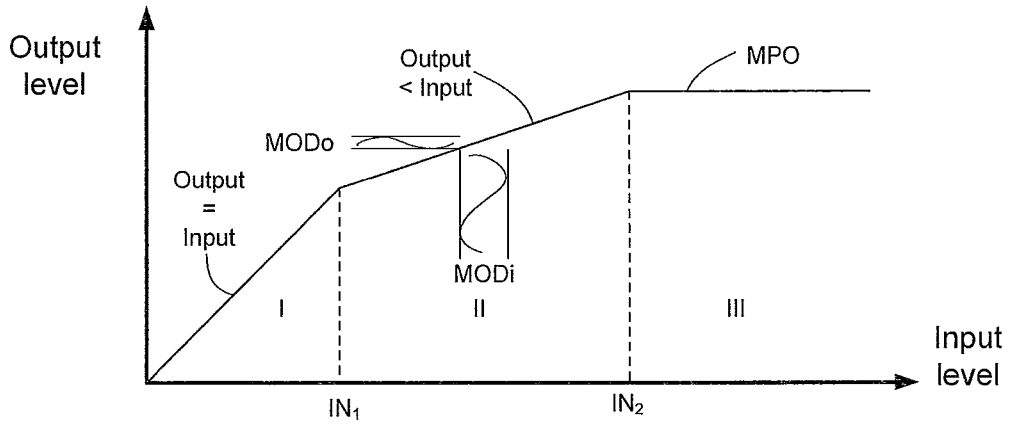
FIG. 4 shows exemplary output amplitude level versus input amplitude level curves in accordance with predefined compression schemes, FIG. 5 schematically shows a hearing threshold curve (solid) and a comfort level curve of a user versus frequency (FIG. 5*a*) and exemplary compression curves at selected frequencies (FIG. 5*b*)

As the listening device 100 may be particularly suited for a hearing impaired person that has a substantially decreased perceptibility concerning the dynamic range of sound pressure levels (or may be specifically adapted for enhancing speech in difficult listening situations including lots of noise), the signal processing unit 130 may be adapted to modify the level of the processed electric output signal 132 as a function of the level of the electric input signal as indicated in FIG. 4. In an embodiment, exemplified by FIG. 4*a*, the compression scheme follows the piecewise linear curve directly. Thus, according to the stored compression scheme, an output amplitude level (Output level) of the processed electric output signal 132 remains unchanged compared to an amplitude level (Input level) of the electric input signal 122 (region I), if the amplitude level of the electric input signal 122 is smaller than a first threshold value $IN_1$. If the amplitude level of the input signal exceeds the first threshold value $IN_1$, the output amplitude level of the processed electric output signal 132 is decreased (compressed) relative to the input amplitude level of the electric input signal 122 (region II). The amplitude level of the processed electric output signal 132 is kept constant at a maximum power output level MPO, if the amplitude level of electric input signal 122 is larger than a second threshold value $IN_2$, $IN_2$ being larger than the first threshold value $IN_1$ (region III). An example of an output modulation (MODo) resulting from an input modulation (MODi) around an input level in region II (between $IN_1$ and $IN_2$) is shown. A substantial compression of the input modulation is provided.

It shall be understood that in each of the compression regions I, II and III, the signal processing unit 130 is preferably controlled such that the output value of the modulation parameter is determined with a view to the input value of the modulation parameter (e.g. equal to) and to the user's hearing impairment and/or to the current acoustic environment (and/or to a speech intelligibility measure).

Figure 4B:
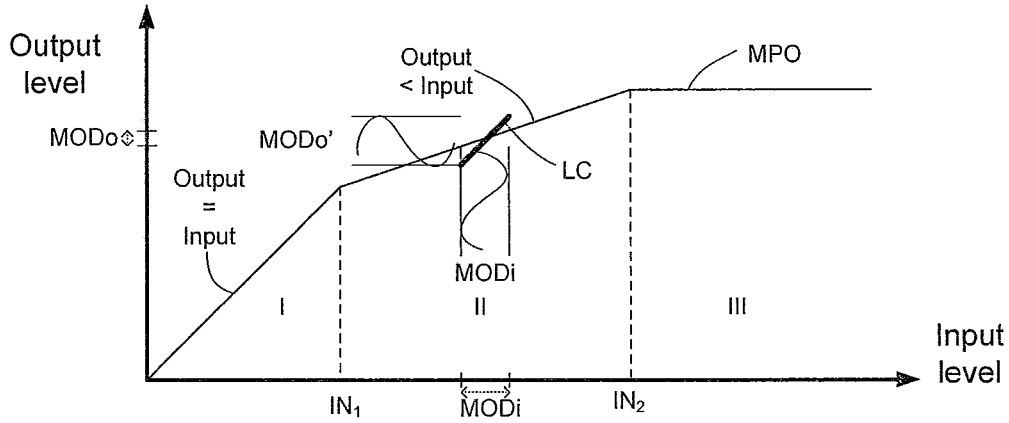

In an embodiment, exemplified by FIG. 4*b*, the compression scheme follows the piecewise linear curve as regards the level around which a given modulation varies, but the compression ratio (slope of the linear curve(s)) is adapted to a user's hearing ability and/or to the current acoustic environment and/or to a speech intelligibility measure, and preferably frequency dependent (cf. FIG. 5). The modified compression ratio (bold curve piece LC) is indicated in the example illustrating a modified output modulation (MODo') resulting from an input modulation (MODi) around an input level in region II of the compression curve. Thereby an output modulation that is optimal for the user can be provided. The slope(s) (LC) of the compression curve, depending on the input level and the frequency (cf. FIG. 5) may e.g. be determined in advance of the use of the listening device, preferably according to a user's hearing ability, e.g. in a fitting session, and stored in the listening device. In the example shown, the modified output modulation MODo' is substantially equal to the input modulation MODi (at the input level in question).

Figure 4C:
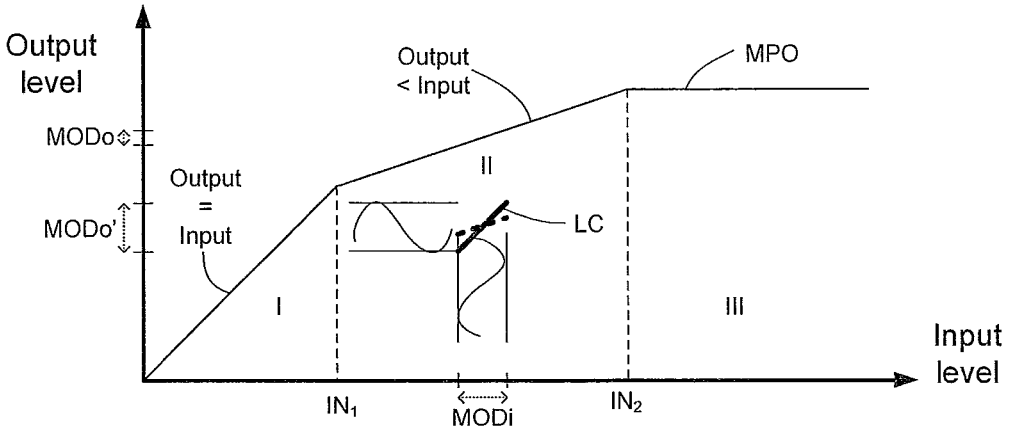
Figure 5A:
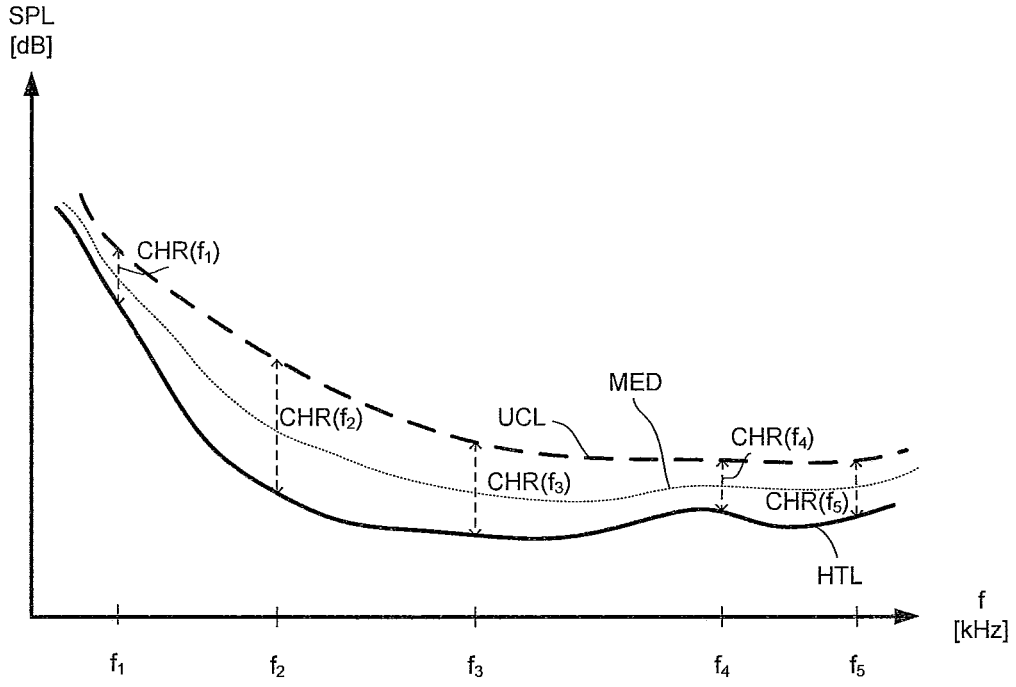
Figure 5B:
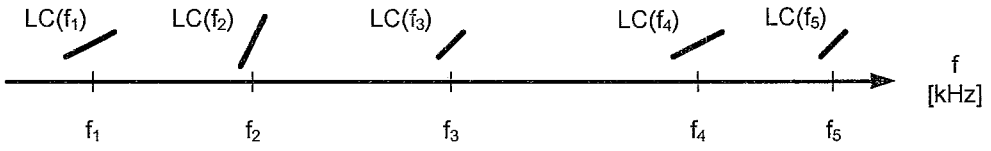

In an embodiment, exemplified by FIG. 4*c*, the level around which a given output modulation varies is modified to comply with a user's hearing ability, e.g. to ensure that the output modulation does not exceed the limits defined by a user's hearing threshold and comfort level curves at a given frequency (cf. FIG. 5). Preferably, the output modulation is controlled to utilize the available headroom between the limits defined by a user's hearing threshold and comfort level curves at a given frequency (cf. FIG. 5*b*), to ensure at least—if possible—that the output modulation is not smaller than the corresponding input modulation (or if not possible that it is as large as possible). The slope (LC) of the modulation curve may further be adapted to the user's hearing ability (as indicated by the bold solid line piece LC). Alternatively, the compression ratio (slopes) of the original curve may be maintained (as indicated by the bold dashed line piece).

Figure 2:
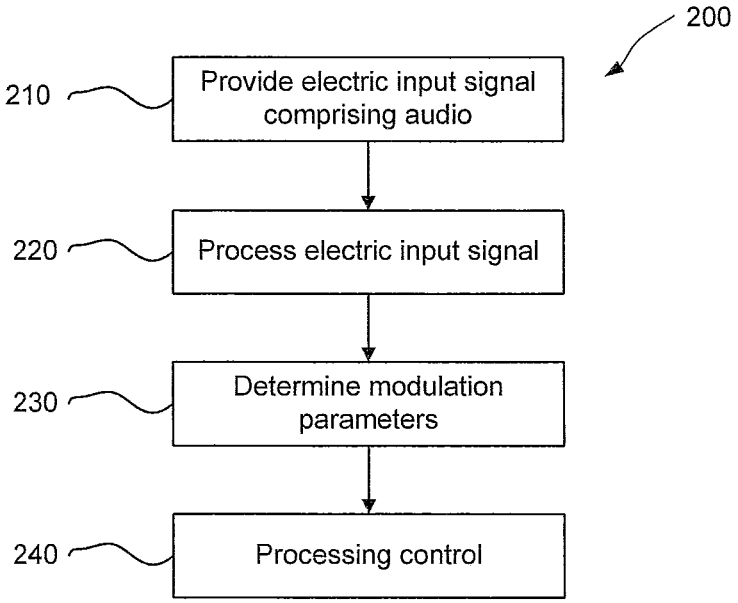
FIG. 2 shows a flow chart illustrating an operating method in accordance with the second aspect of the present application.

FIG. 2 shows a flow chart illustrating the operating method 200 in accordance with the second aspect of the present invention. The operating method 200 principally corresponds to the listening device 100 depicted in FIG. 1. For instance, the listening device 100 can be operated with the operating method 200 or, respectively, the listening device 100 can implement the operating method 200.

Accordingly, in a first step 210, an audio signal is received and converted into an electric input signal. In a second step 220, the electric input signal is processed and a processed electric output signal is output. In a third step 230, an input value of a modulation parameter of the electric input signal and an output value of the same modulation parameter of the processed electric output signal are determined. In a fourth step 240, processing of the electric input signal is controlled in dependence of the determined input value and the determined output value to optimize modulation of the processed electric output signal with respect to speech intelligibility, e.g. such that a difference between the determined input value and the determined output value is reduced over time, preferentially minimized (or is adapted to obtain a predefined (audiological) output target modulation).

FIG. 5*a* schematically shows a hearing threshold curve (solid) (HTL) and a comfort level curve (dashed) (UCL) of a user versus frequency f. The curves HTL and UCL are e.g. expressed in sound pressure level SPL (dB) versus frequency f (kHz). The curves represent, at a given frequency, range of levels of a signal that is high enough for a user to hear (defined by the bottom, solid HTL-curve) AND which is not too high for the user to listen to without pain or irritation (defined by the top, dashed UCL-curve). The (frequency dependent) customized hearing range (CHR) is the range of levels within which a sound signal (ideally) is to be located when presented to a user. A number of different customized hearing ranges (CHR) at frequencies $f_1$ to $f_5$ is indicated in FIG. 5*a* (dashed arrows, CHR($f_n$), n=1, 2, 3, 4, 5). The thin dotted graph MED indicates a median (or average) level between the hearing threshold curve HTL and the comfort level curve UCL. The median level may, in a particular mode of operation of the listening device, be used to adjust an output level to provide maximum output modulation (cf. FIG. 4*c*).

FIG. 5*b* schematically illustrates exemplary compression curves LC($f_n$), n=1, 2, 3, 4, 5) at selected frequencies corresponding to the customized hearing ranges (CHR) of FIG. 5*a*. The frequency dependent slopes (or compression ratios) LC($f_n$) are adapted to the corresponding customized hearing ranges CHR($f_n$). The output levels and the output modulation are preferably adapted to lie within the boundaries of the hearing threshold (HTL) and comfort level (UCL) curves of FIG. 5*a*.

Figure 6A:
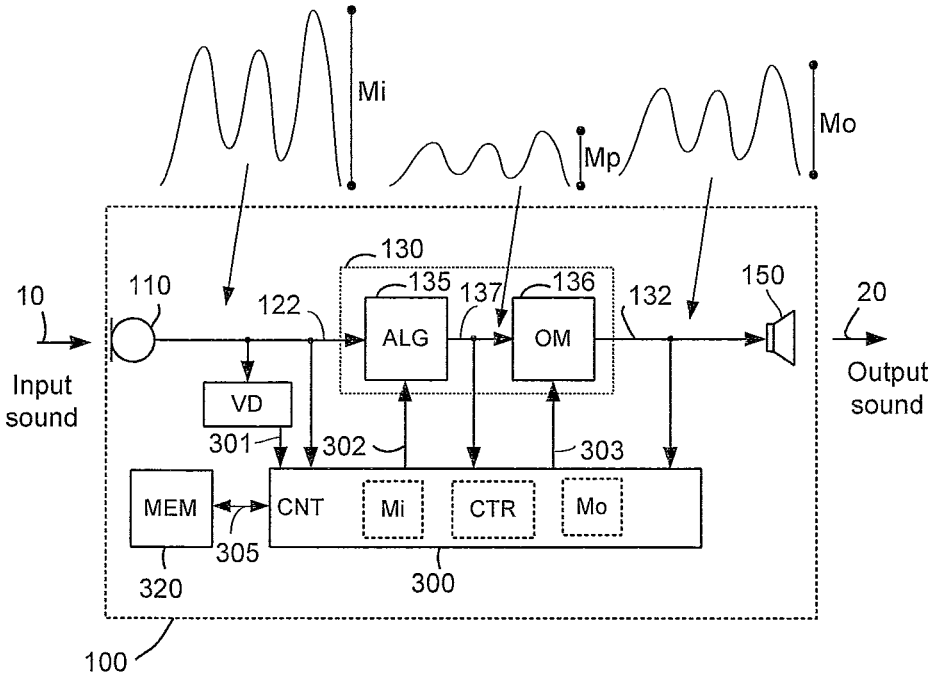
FIG. 6 shows exemplary embodiments of a listening device according to the present application.

FIG. 6*a* shows an alternative embodiment of a listening device according to the present disclosure. The listening device 100 of FIG. 6*a* comprises the same basic elements as the embodiment shown in FIG. 1, including a microphone 110, a signal processing unit 130, a loudspeaker 150, an input measurement unit Mi, an output measurement unit Mo, and a controller CTR. The signals and blocks of FIG. 6*a* having the same reference numerals or signs as in FIG. 1 are intended to have the same meaning (perform the same function) as described in connection with FIG. 1. In the embodiment of FIG. 6*a*, the input measurement unit Mi, the output measurement unit Mo, and the controller CTR are brought together in control unit 300 (CNT). The signal processing unit 130 comprises an algorithm part 135 (ALG) comprising normal processing activities (e.g. frequency dependent amplification, compression, noise reduction, etc.) and an output modulation regulation unit 136 (OM) for, under certain conditions, to control the output modulation of the processed electric output signal 132. The listening device of FIG. 6*a* further comprises a voice detector VD for determining whether or not an input signal comprises a voice (e.g. speech) signal. The voice detector VD provides an input signal 301 to the control unit CNT indicative of whether or not the current input signal comprises a voice. The listening device of FIG. 6*a* further comprises a memory 320 (MEM) wherein relevant data concerning a user's hearing ability, etc., are or can be stored. Data can be read from or written to the memory 320 via signal 305. Data concerning a user's hearing ability may e.g. include frequency dependent data related to a user's audiogram, comfort level, compression (e.g. reference output values). Data (e.g. criteria) related to the classification of a current input signal and requested processing thereof based on modulation parameters of the input signal and the processed output signal, respectively, and possibly depending on the simultaneous detection of a 'voice' or 'no voice' (and/or the value of a speech intelligibility measure), may likewise be stored in memory 320. The control unit 300 (CNT) taps the signal of the forward path (between the microphone 110 and the loudspeaker 150) before and after the algorithm part 135 (ALG) and after the output modulation regulation unit 136 (OM). Thereby the modulation of the input signal 122, the processed input signal 137 (after the normal processing algorithms have been applied to the input signal) and the processed output signal 132 (after an optional regulation of the modulation of the processed input signal 137 has been applied) can be monitored by the control unit 300 (CNT). A classification of the current acoustic situation based on measured (input) modulation parameter values is performed in the control unit 300 (CNT) (possibly using data stored in the memory 320 in the classification process). Corresponding actions based on the classification are performed by the control unit 300 (CNT). Such actions are performed using control signal 302 to the algorithm part (ALG) of the signal processing unit to modify a processing algorithm to indirectly influence the modulation (and/or other properties related to speech intelligibility) of the processed input signal 137 and/or control signal 303 to output modulation regulation unit 136 (OM) to directly modify the modulation of the processed output signal 132. Schematic examples of possible modulation parameter values of the input signal 122 (modulation parameter Mi), the processed input signal 137 (modulation parameter Mp), and the processed output signal 132 (modulation parameter Mo) are shown in the top part of FIG. 6*a*. The example is intended to illustrate that the modulation (Mi) of the input signal may be diminished by the compression scheme and various algorithms (resulting in modulation Mp) and then increased somewhat at the output, resulting in output modulation Mo (here shown to be larger than Mp but smaller than Mi).

Figure 6B:
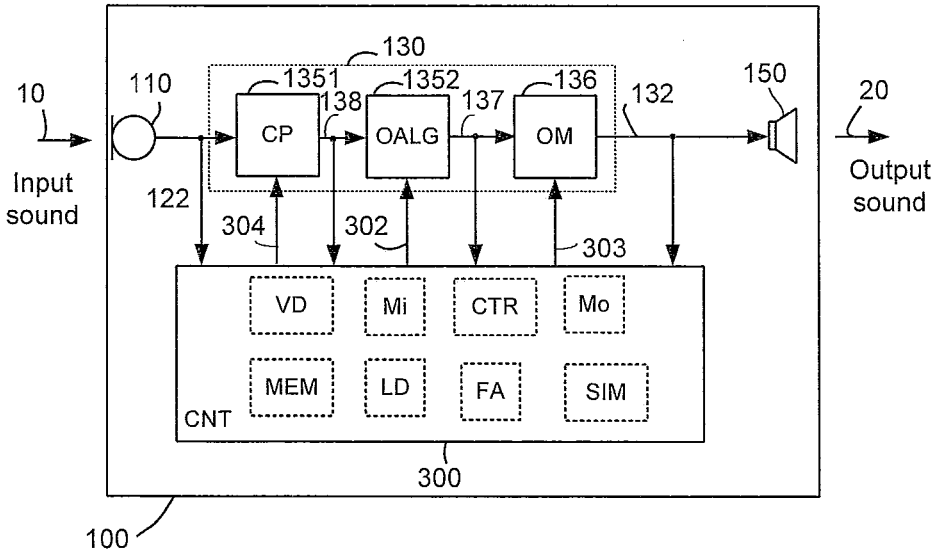

FIG. 6*b* shows yet an alternative embodiment of a listening device according to the present disclosure. The listening device 100 of FIG. 6*b* comprises the same basic elements as the embodiments shown in FIGS. 1 and 6*a*. In the embodiment of FIG. 6*b*, the signal processing unit comprises a compression unit 1351 (CP) for applying a user dependent compression scheme to the input signal and a unit 1352 (OALG) comprising other algorithms for enhancing the signal of the forward parth (in particular with a view to enhanced speech intelligibility). In the embodiment of FIG. 6*a*, the algorithm part 135 (ALG) comprising normal processing activities (e.g. frequency dependent amplification, compression, noise reduction, etc.) comprises units CP and OALG of FIG. 6*b*. Thereby an optional separate control by the control unit 300 (CNT) of the compression algorithm (CP) and other processing algorithms (OALG) (via control signals 304 and 302, respectively) is indicated (e.g. to implement a dynamic frequency dependent adaptation of the compression as indicated in and discussed in connection with FIGS. 4 and 5). Likewise, the reception by control unit 300 (CNT) of a signal 138 of the forward path after the compression algorithm has worked on the input signal is indicated. Such signal 138 (and in case additional signals from the forward path are fed to the control unit after the application of other processing algorithms) may be used in a concluding evaluation of the modulation properties of the input signal and to indicate the influence of various processing algorithms thereon. Thereby an indication—in a given situation—of which processing algorithm contribute to an increase or decrease of the output modulation is provided, and hence an input to a proper corrective action by modification of the algorithm(s) in question. In FIG. 6*b*, the blocks representing a compression algorithm (CP) and other processing algorithms (OALG) are shown in that order. They may, however, be located in reverse order (the OALG being applied before the CP), or some of the 'other processing algorithms' may be applied before the compression algorithm, while others are applied after the compression algorithm.

In the embodiment of a listening device 100 shown in FIG. 6*b*, the control unit 300 (CNT) comprises memory (MEM) and voice detector (VD), which are shown as separate units in the embodiment of FIG. 6*a*. Additionally, the control unit 300 (CNT) of FIG. 6*b* comprises a level detector (LD) for determining a level of one or more of the signals 122, 138, 137, 132 of the forward path. Additionally, the control unit comprises a frequency analyzer (FA) for analysing a frequency spectrum of at least a part of the frequency range (e.g. the part comprising speech) of one or more of the signals 122, 138, 137, 132 of the forward path. Additionally, the control unit comprises an algorithm (SIM) for determining a speech intelligibility measure of one or more of the signals 122, 138, 137, 132 of the forward path. The separate sub-units of the control unit may be used to classify the input signal, to identify the source of modulation changes and/or to determine a proper corrective action (e.g. which algorithm to modify and how) to—in a given acoustic situation—establish an output signal that provides maximum speech perception for the user in question (in certain cases, possibly at the cost of natural sound perception).

A simple classification scheme (and corresponding proposed action by the control unit) based on the input and output modulation is shown in the below table. The output modulation values ('LOW' and 'HIGH') of the tables are understood to refer to modulation before the application of the modulation scheme according to the present disclosure (i.e. equal to the requested output modulation as defined above as the output modulation resulting from the compression scheme and all other algorithms and functions that are in action at a given point in time (to modify the input signal and provide a resulting output signal) without the action of the controller according to the present disclosure). It should further be understood that a 'LOW' and 'HIGH' (and later 'MEDIUM') input modulation (e.g. the input modulation value, e.g. the input modulation depth) is not necessarily equal to a LOW' and 'HIGH' (and later 'MEDIUM') output modulation, respectively, in absolute terms. For a hearing impaired user, the output modulation will typically be lower than the input modulation.

TABLE 1

Classification without voice detector.

| | Input modulation | |
|---|---|---|
| Output modulation | LOW | HIGH |
| LOW | Noise or natural sound<br>No action | Speech<br>Enhance output modulation |
| HIGH | Noise or natural sound<br>Modify algorithm(s) | Speech<br>OK, no action |

An underlying assumption in the above scheme is that if the input modulation is classified as LOW, no voice is present in the input signal, and if the input modulation is classified as HIGH, a voice is present in the input signal. The above scheme may thus be implemented in a listening device which does not have a dedicated voice detector (cf. e.g. FIG. 1). The LOW and HIGH values of input modulation and output modulation in the above table may refer to a modulation parameter, e.g. the modulation index. In an embodiment, a modulation index is classified as LOW and HIGH, if the index is below and above a predefined threshold value, respectively. The LOW and HIGH value of the output modulation may be determined relative to a reference value (e.g. determined during fitting and (possibly purely) based on a compression scheme for the user of the listening device). The following four combinations of input and output modulation are considered:

- In the case of LOW input and LOW output modulation, it is concluded (assumed) that the current input signal corresponds to noise or natural sounds and that no distortion of the output modulation has been introduced. In this case No action from the control unit is necessary (the controller is inactive).
- In the case of LOW input and HIGH output modulation, it is concluded (assumed) that the current input signal corresponds to noise or natural sounds, but that the output modulation has been erroneously increased due to incorrect action of one or more processing algorithms producing artefacts. In this case the control unit is adapted to control the processing to decrease the artefacts (to reduce output modulation). A scheme for such modification of the processing algorithms is preferably stored in the memory MEM. In case that it can be concluded that the increased modulation is introduced to increase speech intelligibility, no action is necessary, however.
- In the case of HIGH input and LOW output modulation, it is concluded (assumed) that the current input signal contains a voice signal and that a distortion of the output modulation has been introduced by the processing algorithms (including e.g. settings related to compression and/or maximum power output). In this case the control unit is adapted to control the processing to enhance (e.g. increase) output modulation. A scheme for such modification of the processing algorithms is preferably stored in the memory MEM.

In the case of HIGH input and HIGH output modulation, it is concluded (assumed) that the current input signal contains a voice signal and that a distortion of the output modulation has not been introduced by the processing algorithms. In this case No action from the control unit is necessary (the controller is inactive).

In a particular embodiment, the listening device comprises a voice detector (cf. VD in FIG. 6) for determining whether or not an input signal (cf. 122 in FIG. 6) comprises a voice signal (at a given point in time). The voice detector is adapted to classify a current acoustic environment of the user as a VOICE or NO-VOICE environment and to forward this information to the controller (cf. control unit CNT in FIG. 6) via a control signal (cf. 301 in FIG. 6*a*).

A classification scheme (and corresponding proposed action by the control unit) based on the input and output modulation and a control signal 301 from the voice detector VD is described in the following example. The output modulation values ('LOW' and 'HIGH') are understood to refer to modulation before the application of the modulation scheme according to the present disclosure.

The below table refers to a no voice (e.g. no speech) environment.

TABLE 2

Classification with voice detector: NO VOICE detected.

| | Input modulation | |
|---|---|---|
| Output modulation | LOW | HIGH |
| LOW | Noise or natural sound<br>No action | Noise or natural sound<br>No action |
| HIGH | Noise or natural sound<br>Modify algorithm(s) | Noise or natural sound<br>No action |

When no voice is detected, it is assumed that the input signal comprises noise and/or natural sounds of varying modulation. Again the following four combinations of input and output modulation are considered:

In the case of LOW input and LOW output modulation, it is concluded (assumed) that no distortion of the output modulation has been introduced. In this case No action from the control unit is necessary (the controller is inactive).

In the case of LOW input and HIGH output modulation, it is concluded (assumed) that the output modulation has been erroneously increased due to incorrect action of one or more processing algorithms producing artefacts. In this case the control unit is adapted to control the processing to decrease the artefacts (to reduce output modulation). A scheme for such modification of the processing algorithms is preferably stored in the memory MEM.

In the case of HIGH input and LOW output modulation, it is concluded (assumed) that a reduction of the output modulation has been (successfully) introduced by the processing algorithms to increase comfort of the user. In this case No action from the control unit is necessary (the controller is inactive).

In the case of HIGH input and HIGH output modulation, it is concluded (assumed) that a reduction of the output modulation has not been introduced by the processing algorithms. In this case either No action from the control unit is necessary (the controller is inactive), or an action to reduce the output modulation to increase comfort of the user may be implemented.

The below table refers to a voice (e.g. speech) environment.

TABLE 3

Classification with voice detector: VOICE detected.

| | Input modulation | | |
|---|---|---|---|
| Output modulation | LOW | MEDIUM | HIGH |
| LOW | Voice<br>No action or modify algorithm(s) | Voice<br>Enhance output modulation | Voice<br>Modify algorithm(s) |
| MEDIUM | Voice<br>No action or Modify algorithm(s) | Voice<br>Enhance output modulation or no action | |
| HIGH | | Voice<br>Modify algorithm(s) | Voice<br>No action |

Each field in the above table are briefly commented on in the following where 'IM' refers to Input Modulation and 'OM' to Output Modulation.

IM-LOW, OM-LOW: Input and output comprise little modulation. No action, if speech is too low to enhance for intelligible speech. Modify algorithm(s), if speech can be made intelligible (e.g. using a speech intelligibility measure to differentiate).

IM-LOW, OM-MEDIUM or IM-LOW, OM-HIGH: Input is not as modulated, as output. Either no action, if it is concluded that the output modulation provides increased speech intelligibility (e.g. as determined from a speech intelligibility measure), or take steps to eliminate artificially produced modulation and re-establish perception of natural sound, if it is concluded that the output modulation creates artefacts (introduced by a processing algorithm).

IM-MEDIUM, OM-LOW: Input is modulated, output not as much. Speech in noise is present. Enhance output modulation and/or other speech cues.

IM-MEDIUM, OM-MEDIUM: Enhance output modulation and/or other speech cues, or take no action, if it is concluded that enhanced output modulation does not provide increased speech intelligibility.

IM-MEDIUM, OM-HIGH: Input is not as modulated, as output. Action as for IM-LOW, OM-MEDIUM or IM-LOW, OM-HIGH.

IM-HIGH, OM-LOW or IM-HIGH, OM-MEDIUM: Input is modulated, output not as much. Dominant speech is present. Speech cues may have been destroyed by processing. Take steps to minimize algorithm errors by modifying a processing algorithm.

IM-HIGH, OM-HIGH: High input modulation and high output modulation. OK. No action.

A learning phase of the listening device may be implemented prior to a normal use of the device. The listening device may comprise a self learning element or unit (e.g. a neural network) adapted to learn a preferred scheme for optimizing a user's intelligibility of speech in a given environment experienced during such learning period. In an embodiment, the listening device comprises a user interface (e.g. a remote control unit). The learning phase may include inputs from a user as to the perception of speech in a given situations (e.g. via the user interface). In an embodiment, the listening device is adapted to run an algorithm providing a speech intelligibility measure of the current input signal. Alternatively, or additionally, the listening device may be adapted to use the speech intelligibility measure instead of or as a supplement to user inputs.

It shall be understood that an arrangement of elements of a respective figure predominately serves a purpose of an evident description; it does not relate to any actual geometric arrangement of parts of a manufactured device according to the invention. Referring for example to the listening device 100 depicted in FIGS. 1 and 6, the described measurement units and the described controller can be installed inside the signal processing unit and must not necessarily be arranged in a respective separate functional block or housing outside of the signal processing unit.

In the claims, the word "comprising" does not exclude other elements or steps, and the indefinite article "a" or "an" does not exclude a plurality.

A single unit or device may fulfil the functions of several items recited in the claims. The mere fact that certain measures are recited in mutually different dependent claims does not indicate that a combination of these measures cannot be used to advantage. Any reference signs in the claims should not be construed as limiting the scope.

Summarizing, the present invention relates to a listening device for a hearing impaired person or for a normal hearing person in difficult listening situations. The present invention furthermore relates to a corresponding operating method of operating a listening device and to a corresponding computer program. In particular, the present invention relates to a listening device that comprises a signal processing unit that is controlled by a controller configured to implement a combined feed-forward and feed-back control in order to ensure that a processed electric output signal is adapted in modulation with a view to at least the modulation of the input signal. Thereby, speech intelligibility is increased, in particular for a hearing impaired person being capable of perceiving sound pressure levels in a decreased dynamic range, only.

The invention claimed is:

1. A listening device for a hearing impaired person, the listening device comprising:

an input transducer configured to provide an electric input signal representing an audio signal;

a signal processing unit configured to process the electric input signal and to output a processed electric output signal;

an input measurement unit configured to determine an input value of a modulation parameter of the electric input signal;

an output measurement unit configured to determine an output value of the same modulation parameter of the processed electric output signal;

a voice detector configured to determine whether or not an input signal comprises a voice signal and to output a control signal indicating whether speech is detected; and a controller coupled to the signal processing unit and being configured to control processing of the electric input signal through the signal processing unit in dependence of the determined input value of the modulation parameter, the determined output value of the modulation parameter, and the control signal output from the voice detector.

2. The listening device of claim 1 wherein the controller is configured to control the signal processing unit such that a difference between the input value of the modulation parameter and the output value of the modulation parameter is changed over time in order to obtain a predefined target output modulation.

3. The listening device of claim 1, wherein the controller is configured to control the signal processing unit such that a difference between the input value of the modulation parameter and the output value of the modulation parameter is reduced over time.

4. The listening device of claim 1 comprising: a hearing aid, a headset, an active ear protection device, a headphone or a combination thereof.

5. The listening device of claim 1, wherein the signal processing unit is configured to process the electric input signal by amplifying the electric input signal in dependence of a frequency of the electric input signal.

6. The listening device of claim 5, wherein the controller is configured to control amplifying of the electric input signal through the signal processing unit in dependence of a predefined compression scheme according to which an output amplitude level of the processed electric output signal is decreased relative to an input amplitude level of the electric input signal, if the amplitude level of the electric input signal is larger than a first threshold value, and the amplitude level of the processed electric output signal is kept constant at a maximum power output level, if the amplitude level of the electric input signal is larger than a second threshold value being larger than the first threshold value.

7. The listening device of claim 6, wherein the controller is configured to dynamically adapt the maximum power output level in dependence of the input value of the modulation parameter and the input amplitude level.

8. The listening device of claim 6 wherein the controller is configured to dynamically adapt the compression ratio and/or the maximum power output level in dependence of the input amplitude level, the input value of the modulation parameter, and the output value of the modulation parameter.

9. The listening device of claim 1, additionally comprising an output transducer configured to convert the processed electric output signal into an acoustic output signal to be presented to the hearing impaired person.

10. The listening device of claim 1, additionally comprising a filter apparatus configured to separate the electric input signal into a number of frequency bands, wherein the signal processing unit, the input measurement unit, the output measurement unit and the controller are configured to operate in each of the number of frequency bands.

11. The listening device of claim 1, wherein the controller is adapted to limit the control of the processing of the electric input signal based on the modulation values of the electric input and output signals in a limited frequency range $[f_{low}; f_{high}]$ where speech intelligibility is primarily influenced.

12. The listening device of claim 1, wherein the controller is configured to adapt the compression ratio based on a user's hearing ability to comply with frequency dependent hearing threshold and comfort level curves of the user.

13. The listening device of claim 1, wherein the input measurement unit and the output measurement unit are each configured to calculate a respective envelope signal of the electric input signal or, respectively, of the processed electric output signal and wherein the modulation parameter is a difference between a maximum value and a minimum value in a respective calculated envelope signal.

14. The listening device of claim 1, wherein the controller is configured to adapt the compression ratio individually at different frequencies.

15. The listening device of claim 1, wherein the controller is configured to adapt the average output level at a given frequency to a median level between the user's hearing threshold and comfort levels.

16. The listening device of claim 1 adapted to provide a speech intelligibility measure to evaluate the quality of the output signal with respect to speech intelligibility.

17. The listening device according to claim 1, wherein the input measurement unit is configured to determine a difference between a positive peak value and a negative peak value of an envelope of the electric input signal in a sampling time period as the modulation parameter of the electric input signal, and the output measurement unit is configured to determine a difference between a positive peak value and a negative peak value of an envelope of the processed electric output signal in the sampling time period as the modulation parameter of the electric output signal.

18. A method of operating a listening device for a hearing impaired person, the method comprising:

receiving an audio signal and converting the audio signal into an electric input signal;

processing the electric input signal and outputting a processed electric output signal;

determining an input value of a modulation parameter of the electric input signal and an output value of the same modulation parameter of the processed electric output signal;

determining whether or not an input signal comprises a voice signal with a voice detector configured to output a control signal indicating whether speech is detected; and controlling processing of the electric input signal in dependence of the determined input value of the modulation parameter, the determined output value of the modulation parameter, and the control signal output from the voice detector.

19. The method according to claim 18, wherein the modulation parameter of the electric input signal is measured as a difference between a positive peak value and a negative peak value of an envelope of the electric input signal in a sampling time period, and the modulation parameter of the processed electric signal is measured as a difference between a positive peak value and a negative peak value of an envelope of the processed electric output signal in the sampling time period.

20. A computer readable tangible non-transitory recording medium storing instructions for causing a listening device for a hearing impaired person to carry out a method of operating the listening device when the instructions are run on a computer controlling the listening device, the method comprising:

receiving an audio signal and converting the audio signal into an electric input signal;

processing the electric input signal and outputting a processed electric output signal;

determining an input value of a modulation parameter of the electric input signal and an output value of the same modulation parameter of the processed electric output signal;

determining whether or not an input signal comprises a voice signal with a voice detector configured to output a control signal indicating whether speech is detected; and controlling processing of the electric input signal in dependence of the determined input value of the modulation parameter, the determined output value of the modulation parameter, and the control signal output from the voice detector.

* * * * *